US009459646B2

(12) United States Patent
Tan et al.

(10) Patent No.: US 9,459,646 B2
(45) Date of Patent: Oct. 4, 2016

(54) VOLTAGE SUPPLY FOR SUPPLYING IN ZONES VOLTAGES PROPORTIONAL TO A MASTER SUPPLY VOTLAGE USING VOLTAGE MIRRORING

(71) Applicant: BROADCOM CORPORATION, Irvine, CA (US)

(72) Inventors: Junhua Tan, Irvine, CA (US); Yuan Yao, Irvine, CA (US); Jing Wang, Riverside, CA (US); Hui Pan, Coto De Caza, CA (US)

(73) Assignee: BROADCOM CORPORATION, Irvine, CA (US)

( * ) Notice: Subject to any disclaimer, the term of this patent is extended or adjusted under 35 U.S.C. 154(b) by 29 days.

(21) Appl. No.: 14/601,062

(22) Filed: Jan. 20, 2015

(65) Prior Publication Data

US 2016/0161972 A1 Jun. 9, 2016

Related U.S. Application Data

(60) Provisional application No. 62/088,116, filed on Dec. 5, 2014.

(51) Int. Cl.

| | |
|---|---|
| ***G05F 3/02*** | (2006.01) |
| ***G05F 1/10*** | (2006.01) |
| ***G05F 3/26*** | (2006.01) |

(52) U.S. Cl.
CPC ..... *G05F 3/262* (2013.01)

(58) Field of Classification Search
CPC ..... G05F 3/262; G05F 1/56
See application file for complete search history.

(56) References Cited

U.S. PATENT DOCUMENTS

| | | | | |
|---|---|---|---|---|
| 6,204,706 | B1 * | 3/2001 | Horvath | G06F 1/28 327/143 |
| 7,663,426 | B2 * | 2/2010 | Fong | G11C 5/14 327/408 |
| 8,212,400 | B2 * | 7/2012 | Wu | H02J 1/08 307/52 |

* cited by examiner

*Primary Examiner* — Emily P Pham
(74) *Attorney, Agent, or Firm* — Oblon, McClelland, Maier & Neustadt, L.L.P.

(57) ABSTRACT

A scaled voltage supply to supply voltage biases to circuits in voltage zones. The scaled voltage supply includes a master voltage corresponding to a voltage drop across a master-upper rail having a voltage $V_{dd}$ and a master-lower rail having a voltage $V_{ss}$=0. Further, the supply includes a voltage-divider network dividing the master voltage $V_{dd}$ into intermediate voltages $\alpha V_{dd}$, $\beta V_{dd}$, etc., wherein α and β are predetermined constants. These intermediate voltages scale with the master voltage and are supplied to the voltage zones using non-invasive soft rails. In one implementation the soft rails use voltage mirrors to supply the intermediate voltages to the circuits within voltage zones.

20 Claims, 6 Drawing Sheets

VOLTAGE SUPPLY FOR SUPPLYING IN ZONES VOLTAGES PROPORTIONAL TO A MASTER SUPPLY VOTLAGE USING VOLTAGE MIRRORING

BACKGROUND

1. Field

This disclosure relates to voltage mirroring circuits supplying scalable voltage biases across all circuits in voltages zones to prevent over-voltage stress at minimum cost in voltage headroom, and more particularly relates to voltage scaled biasing and device stacking for high-voltage operations.

2. Description of the Related Art

In conventional communication systems there is a tradeoff between transmission speed and transmission distance. As lithography and wafer processing technologies enable fabrication of circuits with finer features and thinner gate oxides, the next generation circuits will continue to operate at ever higher speeds, but the over voltage (OV) rating at which these circuits become susceptible to dielectric breakdown also continues to decrease, according to the Johnson limit. Communicating over long distances with large attenuation can require that the transmitted signal is sent as a high voltage signal exceeding the OV rating of fast circuits having thin gate oxides.

For example, a 28 nm thick oxide is rated at 1.8V, and thus a 28 nm thick oxide does not support high voltage, e.g., 3.3V, applications such as Ethernet over unshielded twisted pair (UTP). On the other hand, laterally diffused MOSFET (LDMOS) circuits are compatible with operation at 3.3V across the drain and source. However, LDMOS circuits are too slow and bulky for wideband applications such as 1000BASE-T1 automotive Ethernet.

Some conventional circuits use device stacking to extend the upper bound of voltage scaling in technologies using devices with low OV ratings. However, device stacking also creates inflexibility at the lower bound of voltage scaling, making it difficult to manufacture a single high-bandwidth circuit capable of satisfying alternatively the requirements for low power operation when high voltage signals are not required, and trading off power consumption for high voltage operation when high voltage signals are required. For example, in case of low attenuation and low noise (e.g., in a communication system using short coaxial cables), power saving may be desirable or even mandatory by decreasing the supply voltage. However, the flexibility to decrease the supply voltage may be absent in circuits using conventional device stacking configurations. A wide range of voltage scaling can provide an important advantage, for example, in 100/1000BASE-T1 automotive and small business Ethernet applications. Conventional circuit configuration can be improved to provide better voltage scaling, creating flexibility in a single circuit to alternatively transmit high-voltage signals in applications with high attenuation or noise or by scaling down the supply voltage to save power by transmitting lower voltage signal in applications without high attenuation and noise.

SUMMARY

According to aspects of the disclosure, there is provided a voltage supply, including: a voltage-divider network dividing the master voltage into at least one intermediate voltage; and a plurality of voltage zones, each voltage zone including at least one main circuit. Further included in the voltage supply is at least one soft rail, which is configured to provide voltage biasing to the plurality of voltage zones, and the voltage of the at least one soft rail being the at least one intermediate voltage. Additionally, the voltage biasing includes at least one voltage mirroring circuit configured to provide voltage bias to the at least one soft rail and configured to maintain the voltage of the at least one soft rail at the at least one intermediate voltage, wherein the at least one intermediate voltage scales with the master voltage.

BRIEF DESCRIPTION OF THE DRAWINGS

A more complete understanding of this disclosure is provided by reference to the following detailed description when considered in connection with the accompanying drawings, wherein.

DETAILED DESCRIPTION

Figure 1:
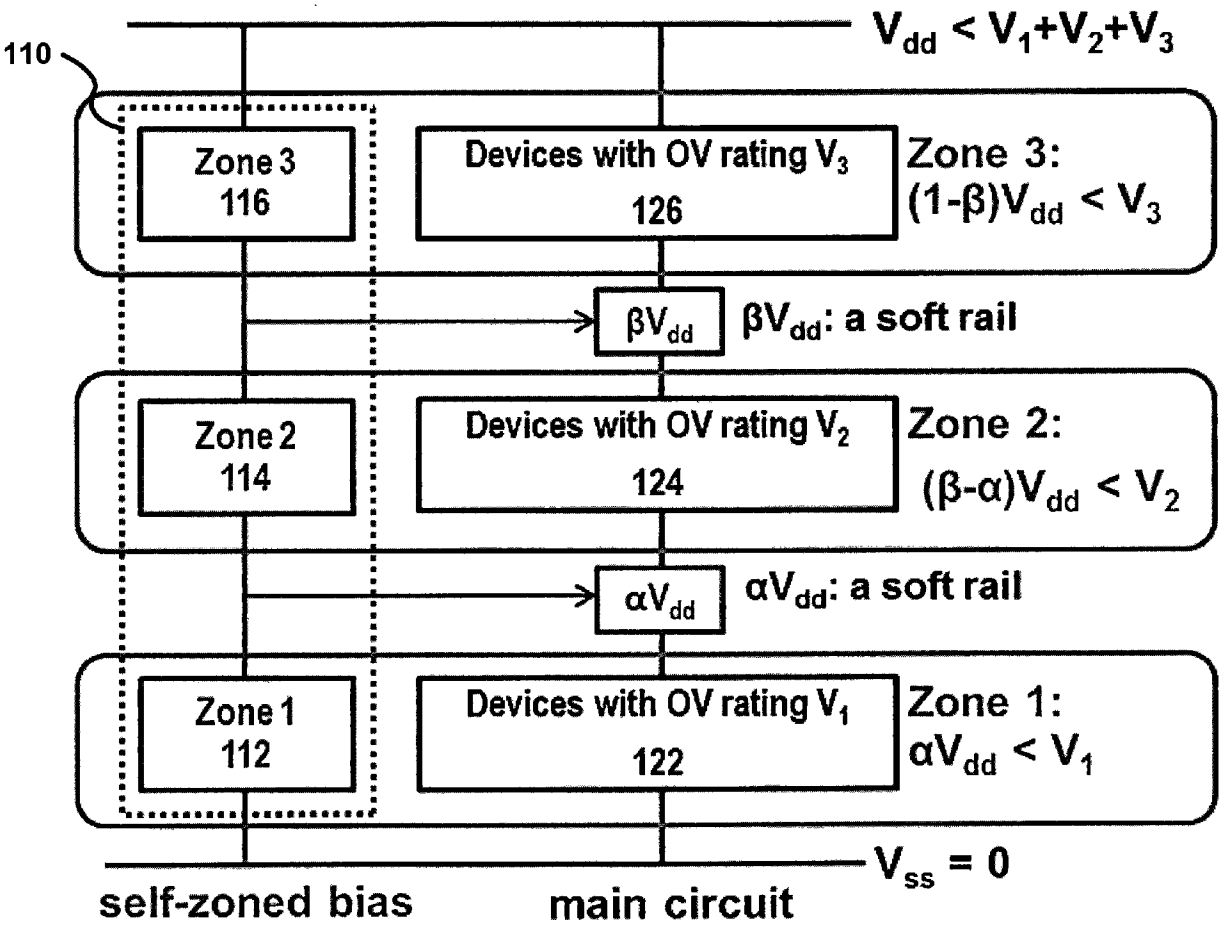
FIG. 1 shows a schematic drawing of an implementation of a self-zoned biasing circuit providing two soft rails that divide the main circuits within three voltage zones.

To overcome the scaling inflexibility of conventional device stacking circuits, main circuits can be organized into voltage zones, with each voltage zone receiving voltage biases from non-invasive soft rails using a voltage mirror configuration, wherein the voltage mirrors act as a buffer circuit between a voltage divider network that determines the scaled voltages of the rails and the main circuits that receives voltage bias from the rails. These voltage mirrors are referred to alternatively as "buffer circuits" or as "biasing circuits." Because the non-invasive soft rails are also applied to the biasing circuits themselves using circuit elements with the same over voltage (OV) rating as the main circuit components in the corresponding voltage zones, the biasing circuit supplying voltage bias to the respective voltage zones is said to be "self zoned." One of ordinary skill in the art will understand that the voltage scaling architecture discussed herein can be realized using circuit elements in the biasing circuits having different OV ratings than the circuit elements in the corresponding main circuits. Thus, the self-zoned feature and the voltage-scaling feature discussed herein can be realized independently.

The self-zoned biasing circuit supplies voltage bias to a plurality of voltage zones, wherein each voltage zone corresponds to a voltage drop that is a predetermined ratio of a master voltage that is supplied by a master power supply. When the master voltage changes either increasing or decreasing, the voltage zones scale with the master voltage maintaining a voltage drop that is the predetermined ratio of the master voltage. The voltage zones are distinguished from conventional over-voltage (OV) prevention circuits by several features.

First, in contrast to a conventional device stacking circuit architecture that is technology dependent; the architecture of the voltages zones and the voltage drop applied across each zone discussed herein are technology independent.

Second, the voltage-zone rails are non-invasive, meaning the insertion of the rails perturbs the main circuits and the self-zoned biasing circuits very little. The rail voltages are applied to the circuits through voltage buffer circuits mirroring the outputs of a voltage-divider network. In one implementation, voltage mirror includes the gate of a first field-effect transistor (FET) being connected to a drain and gate of a second FET and the source of the second FET is directly connected to the voltage divider network. In this implementation, the source of the first FET provides voltage bias to the circuits, and the source of the first FET is maintained at a voltage corresponding to the voltage divider network output without electrical current being drawn directly from the voltage divider network for use in the circuit. When the first FET is inserted at a node of the circuit, the drain of the first FET is connected to the low impedance (Lo-Z) or high voltage swing (Hi-S) side of the circuit node, while the source of the first FET is connected to the high impedance (Hi-Z) side of the circuit node. Thus, the soft rails are said to be non-invasive because rail voltage bias is applied to the circuit node without disturbing the node impedance and signal swing.

Third, when the master supply voltage becomes low, the FETs in the buffer circuits squash to the triode region and the voltage rails provided by the buffer circuits become "soft", minimizing the headroom voltage occupied by the buffer circuits at low voltage scaling of the master voltage. Of course, some headroom is taken by the FET providing voltage bias to the zoned circuit. This headroom is determined by the drain-to-source voltage of the first FET of the voltage mirror FET pairings. The drain-to-source voltage becomes small when FET operates in the triode region. Also, the headroom taken by the first FET becomes a more significant issue when the master voltage becomes small. Thus, it is advantageous that for master voltages less than a predetermined voltage threshold the first FET will operate in the triode region rather than the saturation region, resulting in decreasing the headroom taken by the first FET (i.e., the FET providing the soft rail or voltage bias to the main or self-zoned biasing circuits) when the master voltages is less than the predetermined voltage threshold.

The voltage drop across each voltage zone is determined by the voltage divider network, but the circuits in the voltage zones and receiving voltage bias from the soft rails do not draw current directly from the voltage divider network. Rather, current is sourced to each of the voltage-zoned main and bias circuits through voltage mirrors, as discussed above. Each voltage mirror includes a first and a second FET. The second FET has its drain electrically connected to its gate and has its source connected to the voltage divider network. Then the source of the second FET is mirrored to be equal to the source of first FET. This mirroring of the source voltages is achieved by choosing the parameters of the first and second FETs such that when a predetermined current flows through the second FET, then the current sourced by the first FET is such that the gate-to-source voltage of the first FET equals the gate-to-source voltage of the second FET. Because the gates of the two FETs are electrically connected and the gate-to-source voltage of the first and second FETs are equal, the source voltage of the first FET will equal source voltage of the second FET. Therefore, the main and bias circuits are provided with voltage bias by a non-invasive soft rail that is scaled to the master voltage even though the main and bias circuits are not directly connected to the voltage divider network determining the voltage scaling.

Referring now to the drawings, wherein like reference numerals designate identical or corresponding parts throughout the several views, FIG. 1 shows a schematic diagram of a circuit supplying voltage biases to circuits in three zones. The use of three zones in FIG. 1 is illustrative. One of ordinary skill in the art will recognize that more zones than three or less zones than three can also be used. A master power supply applies an upper voltage $V_{dd}$ and a lower voltage $V_{ss}$, which is taken to be a reference voltage of zero (i.e., $V_{ss}=0$). A self-zoned bias circuit 110 obtains the intermediate voltage values $\beta V_{dd}$ and $\alpha V_{dd}$ from the master voltage, where $0<\alpha<<1$. The self-zoned bias circuit 110 includes a zone 1 portion 112, a zone 2 portion 114, and a zone 3 portion 116. In one implementation, the self-zoned bias circuit 110 includes a voltage divider network. In one implementation, the voltage divider network can be a series of high-impedance resistors with values of approximately 1 MΩ or greater.

The intermediate voltages $\beta V_{dd}$ and $\alpha V_{dd}$, are then supplied to the circuits within the respective first, second, and third zones using non-invasive soft rails. Thus, in zones 3, the circuits have an OV rating $V_3$ that is greater than the voltage drop $(1-\beta)V_{dd}$ applied to zone 3. Similarly, in zones 2, the circuits have an OV rating $V_2$ that is greater than the voltage drop $(\beta-\alpha)V_{dd}$ applied to zone 2. Finally, in zones 1, the circuits have an OV rating $V_1$ that is greater than the voltage drop $\alpha V_{dd}$ supplied to zone 1.

In the self-zoned bias circuit, a buffer circuit is provided between the voltage divider network 110 and the main circuits 122, 124, and 126. Thus, the main circuits drawing current from the rails having voltages $\beta V_{dd}$ and $\alpha V_{dd}$ do not disturb or otherwise perturb the ratios $\beta$ and $\alpha$ because the buffer circuits isolate the voltage divider network determining the voltages $\beta V_{dd}$ and $\alpha V_{dd}$ from downstream effects such as perturbations resulting from the main circuits. In one implementation, the buffering between the voltage divider network and the main circuits is provided by voltage-mirror circuits.

In one implementation, the bias circuits (i.e., the zone 1 bias circuit 112, zone 2 bias circuit 114, and zone 3 bias circuit 116) generating the soft rails are OV free (i.e., they are OV free because their OV rating is greater than the voltage drop applied across them) because the bias circuits have the same OV rating as the corresponding main circuits. Thus, the bias circuits 112, 114, and 116 in the self-zoned bias circuit 110 are said to be self-zoned. The feature of being OV free results from being self-zoned by biasing circuit elements having the same OV rating as the main circuit elements in the corresponding voltage zone. The configuration of voltage zones illustrated in FIG. 1 overcomes the limitations of conventional device stacking configurations by extending the upper bound of $V_{dd}$ scaling through device stacking, while avoiding the limitations at the lower hound of conventional device stacking configurations. This configuration overcomes these limitations because the voltage drop corresponding to each voltage zones scale with the master voltage.

Figure 2:
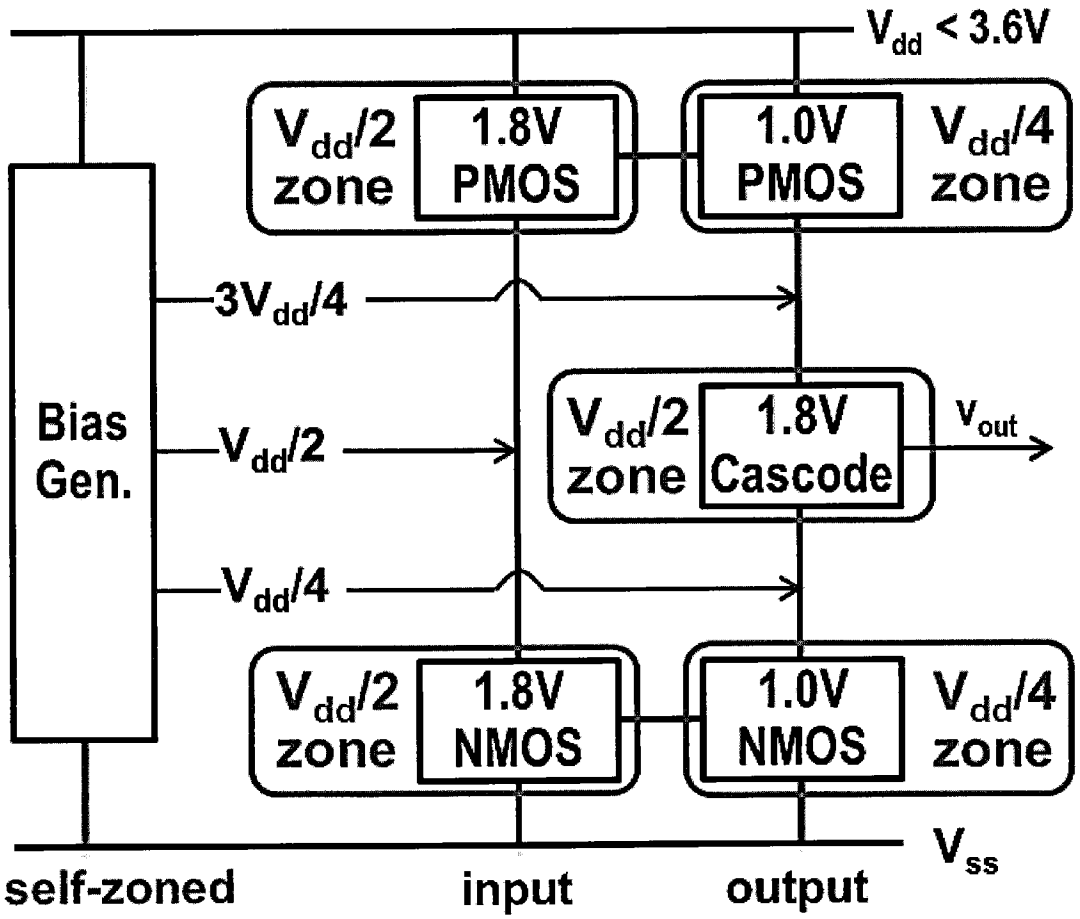
FIG. 2 shows a schematic drawing of an implementation of the self-zoned biasing circuit providing three soft rails that divide the main circuits within five voltage zones.

FIG. 2 shows one implementation of noninvasive voltage zoning for OV-free $V_{dd}$ scaling. FIG. 2 is an example of noninvasive voltage zoning for OV-free $V_{dd}$ scaling in which three soft rails are used to create five voltage zones. Further, of the five voltage zones in FIG. 2 three of the voltage zones are designated as providing voltage bias for output main circuits and two of the voltage zones are designated as providing voltage bias for input main circuits. In this example $V_{dd}$ is maintained below a value of 3.6V. The self-zoned bias circuit 110 supplies via soft rails voltages corresponding to $V_{dd}/4$, $V_{dd}/2$, and $3V_{dd}/4$.

The input main circuits are categorized into two voltage zones: an upper $V_{dd}/2$ zone and a lower $V_{dd}/2$ zone. The upper $V_{dd}/2$ zone includes a main circuit having PMOS circuit elements rated with an OV rating of 1.8V. Similarly, the lower $V_{dd}/2$ zone includes a main circuit having NMOS circuit elements rated with an OV rating of 1.8V.

Among the output circuits, three zones are provided: an upper $V_{dd}/4$ zone, a middle $V_{dd}/2$ zone and a lower $V_{dd}/4$ zone. The upper $V_{dd}/4$ zone includes a main circuit having PMOS circuit elements rated with an OV rating of 1.0V. Similarly, the lower $V_{dd}/4$ zone includes a main circuit having NMOS circuit elements rated with an OV rating of 1.0V. Finally, the middle $V_{dd}/2$ zone includes a main circuit having both NMOS and PMOS circuit elements arranged in a Cascode configuration and the Cascode configured circuitry is rated with an OV rating of 1.8V. One of ordinary skill in the art will understand that many zoning configurations of self-zoned biasing circuits and main-circuit zones are possible and that the configuration in FIG. 2 is illustrative of the broad general concept.

Figure 3:
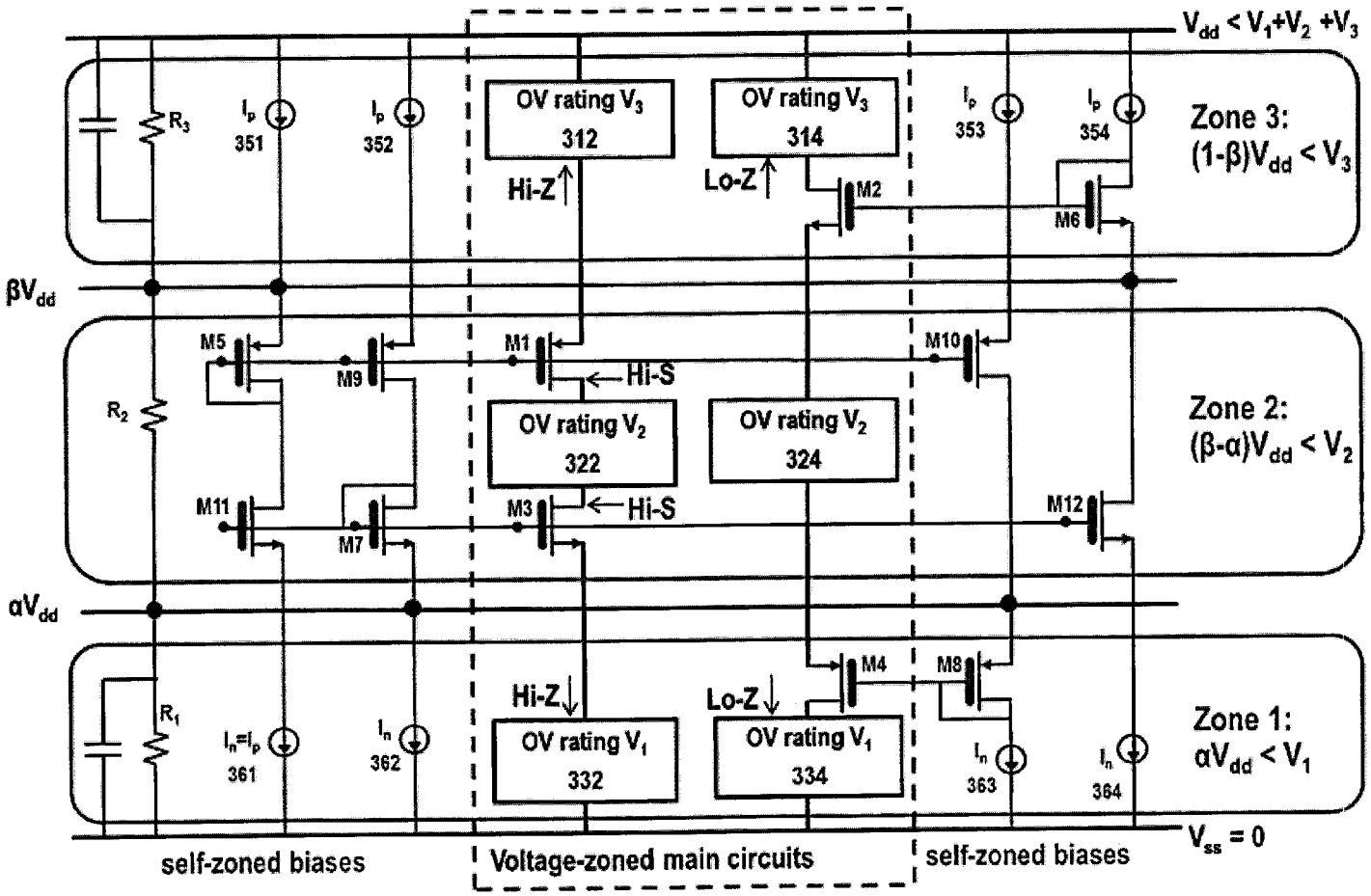
FIG. 3 shows a schematic drawing of an implementation of the self-zoned biasing circuit configured as voltage mirrors using pairs of field effect transistors (FETs) having the source of a first FET providing a soft rail to a main/self-zoned biasing circuit and having the gate of the first FET electrically connected to the gate and drain of a second FET.

FIG. 3 shows a schematic of an example implementation of the self-zoned biasing circuits using soft-rails for voltage zoning. In FIG. 3, the voltage divider network is realized using a series of three resistors $R_1$, $R_2$, and $R_3$, wherein each of $R_1$ and $R_3$ include a capacitor in parallel. In FIG. 3, the main circuits are given by rectangles labeled by the corresponding OV rating of the main circuitry. All of the current sources and FETs shown in FIG. 3 correspond to the self-zoned biasing circuitry supplying the voltages $\beta V_{dd}$ and $\alpha V_{dd}$ on corresponding soft-rails. The designation "Hi-Z" together with the corresponding arrow indicates the input impedance of the adjacent main circuit is high impedance. The designation "Lo-Z" a together with the corresponding arrow indicates the input impedance of the adjacent main circuit is low impedance. Finally, the label "Hi-S" together with the corresponding arrow indicates the adjacent main circuit is high-swing circuitry (e.g., the circuit may have an output voltage that swings all the way from the lower rail to the upper rail of the circuit's voltage zone).

Next, the operation of the self-zoned biasing circuits will be described with reference to FIG. 3. The predetermined electrical current biasing main circuit 314 is proportional to the current $I_p$, which is sourced by current source 354 and is flowing through FET M6. The gate and drain of the FET M6 are electrically connected to the gate of FET M2. The parameters of FET M6 and FET M2 can be chosen such that the gate-to-source voltage of FET M6 is equal to the gate-to-source voltage of FET M2 when the current through FET M6 is $I_p$ and the known current required by main circuit 314 is flowing through FET M2. Additionally, the drain-to-source voltage of FET M2 can be minimized in order to minimize the headroom subtracted from the voltage supplied to the main circuit 314. As indicated by the dot near the source of FET M6, the source of FET M6 is electrically connected to the voltage divider network and is maintained at the voltage $\beta V_{dd}$. Thus, the source of FET M2 is also maintained at voltage $\beta V_{dd}$ because the gate voltage of FET M2 and FET M6 are equal and the pairing of FET M2 and FET M6 is chosen such that the gate-to-source voltage of FET M2 is equal to the gate-to-source voltage of FET M2. The configuration of FET M2 with FET M6 is particularly chosen for a main circuit such as main circuit 314 having a low input impedance in order that the high impedance output of the drain of the NMOS FET M2 acts to minimize perturbation to the main circuit when connected with the low input impedance of main circuit 314.

All of the current flowing through FET M6 will also flow through FET M12, which is paired in a current mirror configuration with FET M7. The parameters of this paring between FET M12 and FET M7 are chosen such that the current $I_p$ is equal to $I_n$ to within a few micro amps. Similarly, the parameters of FET M11 and M7 are chosen such that the current flowing through FET M11 is equal to the current flowing through FET M7. Each of the current supplies 361, 362, 363, and 364 respectively source current $I_n$ to the FETs M11, M7, M8, and M12. Each of the current supplies 351, 352, 353, and 354 respectively source $I_p$ current to the FETs M5, M9, M10, and M6. Thus, in FIG. 3 the current of each of the current sources is effectively equal to all of the other current sources shown in FIG. 3.

To supply voltage bias to main circuit 312, which circuit has a high input impedance, the PMOS configuration of a voltage mirror is used consisting of FET M1 and FET M5. The gate of FET M1 is connected to the gate and drain of FET M5. The source voltage of FET M1 is maintained at the voltage $\beta V_{dd}$ by choosing the parameters of FET M1 and FET M5 such that gate-to-source voltages of FET M1 and FET M5 are equal when the desired bias current is being supplied to main circuit 312. Thus, the source of FET M1 will be maintained at the same voltage as the source of FET M5, which is connected to the voltage divider network and therefore maintained at $\beta V_{dd}$.

Similar reasoning can be used to determine that the sources of the FETs supplying voltage biases to the main circuits 332 and 334 are being maintained at the voltage of the soft rail $\alpha V_{dd}$. Similar to main circuit 314 being supplied with voltage bias using the NMOS paring of FET M2 and FET M6, main circuit 334 is supplied with voltage bias using the PMOS pairing of FET M4 and FET M8. The gate of FET M4 is connected to the gate and drain of FET M8. The parameters of FET M4 and FET M8 are selected such that the gate-to-source voltages of FET M4 and FET M8 are equal when main circuit 334 is biased with a predetermined current. Because the source of FET M8 is maintained at the voltage $\alpha V_{dd}$, the source of FET M4 is also maintained at the voltage $\alpha V_{dd}$ and main circuit 334 is biased with the voltage $\alpha V_{dd}$.

Similar to the main circuit 312 being biased using the PMOS paring of FET M1 and FET M5, main circuit 332 is biased using the NMOS paring of FET M3 and FET M7. The gate of FET M3 is connected to the gate and drain of FET M7. The parameters of FET M3 and FET M7 are selected such that the gate-to-source voltages of FET M3 and FET M7 are equal when main circuit 332 is biased with a predetermined current. Because the source of FET M7 is maintained at the voltage $\alpha V_{dd}$, the source of FET M3 is also maintained at the voltage $\alpha V_{dd}$ and main circuit 332 is supplied with the voltage $\alpha V_{dd}$.

Regarding supplying voltage bias to main circuit 324, as discussed above the source of FET M2 is maintained at the voltage $\beta V_{dd}$ and the source of FET M4 is maintained at the voltage $\alpha V_{dd}$. Thus, the voltage drop across main circuit 324 is maintained at a voltage of $(\beta-\alpha)V_{dd}$. Similarly, the voltage drop across the main circuit 322 is maintained at a voltage of $(\beta-\alpha)V_{dd}$ minus the headroom corresponding to the drain-to-source voltage across both of FET M1 and FET M3.

When a soft rail is applied to a main circuit node where either the node impedance is low or the voltage swing is high, the rail voltage is applied with the high-impedance drain of the first FET(s) of the voltage mirror connected to the main circuit node. For example, voltage biases are applied to main circuit 322, which operates in a high voltage swing mode, by the high output impedance drains of FETs M1 and M3. For main circuits having low input impedance, the drain of the voltage biasing FET is also connected to the main circuit. For example, the drain of FET M4 is connected to main circuit 334, and the drain of FET M2 is connected to main circuit 314.

As the voltage $V_{dd}$ changes to accommodate the requirements of a particular application, the soft rails will respectively track the voltages $\beta V_{dd}$ and $\alpha V_{dd}$ and thus scale proportionally with $V_{dd}$. For applications requiring higher output voltages, a higher $V_{dd}$ can be applied to the circuit, as long as $V_{dd}$ does not cause the OV ratings to be exceeded. On the other hand, when power conservation is desired and high voltage signals are not required to overcome noise and attenuation, then a lower $V_{dd}$ can be applied to the circuit. As the master voltage $V_{dd}$ decreases further the FETs will eventually transition at a predetermined voltage from operation in the saturation region to operation in the triode region. Advantageously, the headroom contributed by the FETs decreases when operating in the triode region. Thus, at low $V_{dd}$, when the headroom occupied by the FETs M1-M4 can potentially become a significant issue, the FETs squash to triode advantageously occupying less headroom.

Figure 4:
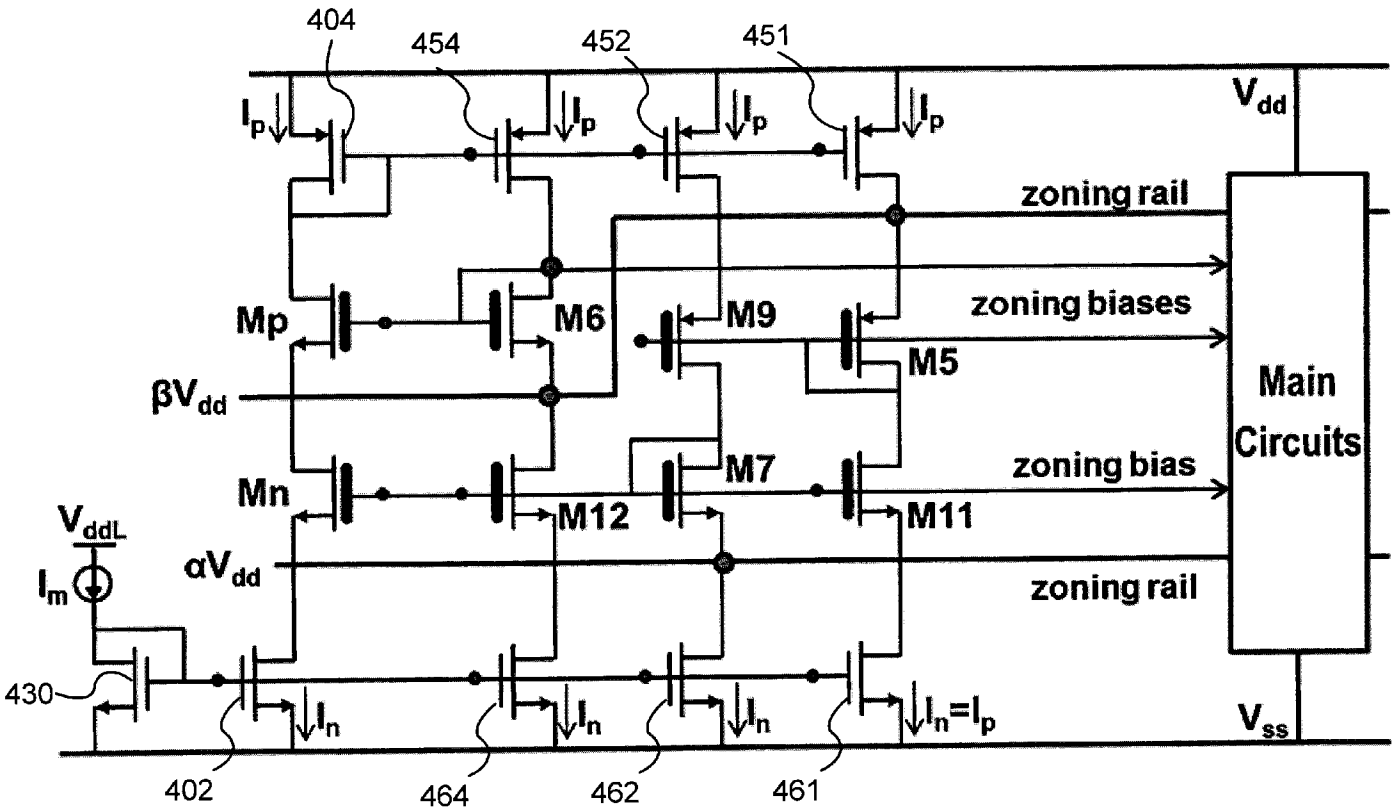
FIG. 4 shows a schematic drawing of an implementation of the self-zoned biasing circuit providing soft rails to main circuits, wherein the current sources are current mirrors tied to a master current $I_m$.

FIG. 4 shows another implementation of the self-zoned biasing circuitry. In order to simplify the discussion, FETs M1, M2, M3, M4, M8, and M10, which were shown in FIG. 3, are not shown in FIG. 4. Also, the voltage rails $\alpha V_{dd}$ and $\beta V_{dd}$ are shown in FIG. 4, but the voltage divider network creating these rails, which is also shown in FIG. 3, is also not shown in FIG. 4. FIG. 4 shows an implementation of the current sources 351, 352, 354, 361, 362, and 364 shown in FIG. 3. The FETs Mp and Mn are added in the master current branch to aid in generating the bias rails for self-zoning. A current mirror is configured between FET 430 and FET 402 such that a predetermined current $I_n$ flows through FET 402. Similarly, FETs 461, 462, and 464 each paired with FET 430 to create three current mirrors, such that the predetermined current of $I_n$ flowing through FET 402 also flows through each of FETs 461, 462, and 464. The FETs 430, 402, 461, 462, and 464 are chosen to have the same OV rating as the main circuits in zone 1. Therefore, zone 1 is said to be self-zoned. Regarding the PMOS FETs corresponding to zone 3, the configuration of FET 404 together with FET 454 forms a current mirror such that the predetermined current $I_p$ flowing through FET 454 equals the current $I_n$ flowing through FET 402. Similarly the current of FET 451 and 452 is also mirrored from FET 404. The FETs 404, 451, 452, and 454 are chosen to have the same OV rating as the main circuits in zone 3. Therefore, zone 3 is said to be self-zoned. It is noted that FET Mp uses an n-type MOSFET rather than a p-type MOSFT in order that the high-impedance drain of FET Mp is connect to the low-impedance PMOS diode of FET 404. The master current $I_n$, is generated in the standard CMOS domain using a standard supply voltage $V_{ddL}$ without the need for OV protection.

Figure 5A:
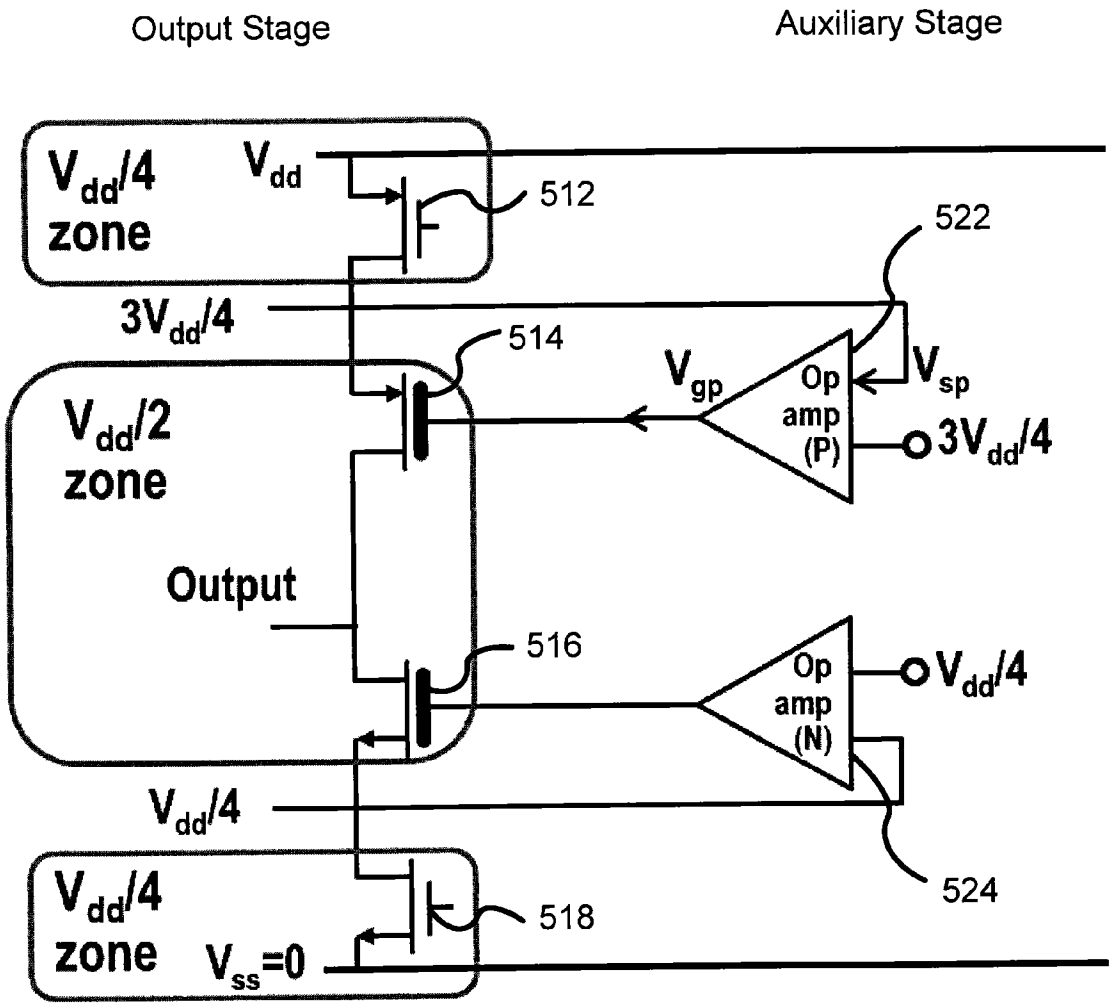
FIG. 5A shows a schematic drawing of an example of main circuits, wherein the auxiliary opamp and cascode combinations provide soft rails to the output circuits.
Figure 5B:
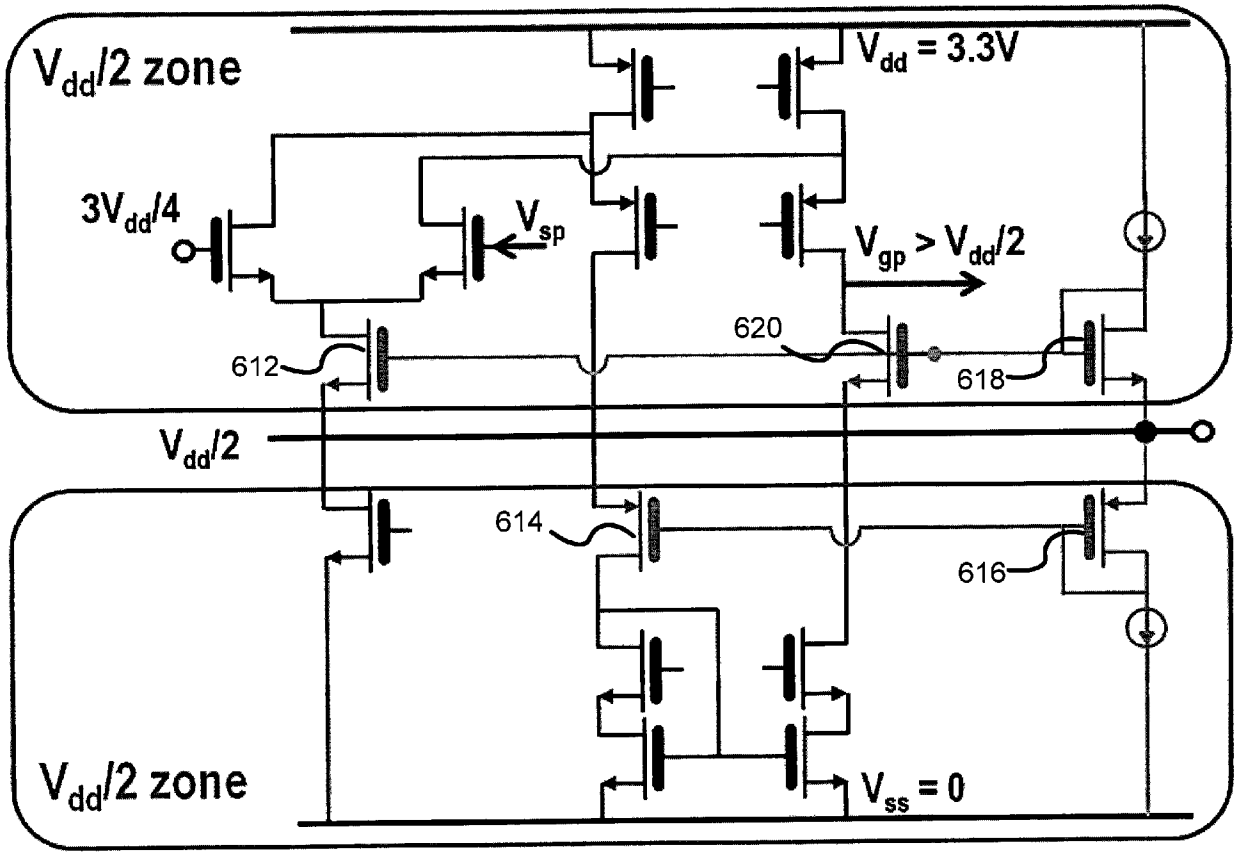
FIG. 5B shows a schematic drawing of an example of the auxiliary opamp circuits for which a self-zoned biasing circuit provides the soft rails.

FIGS. 5A and 5B show an example of main circuits receiving voltage biases from self-zoned biasing circuitry, wherein the self-zoned biasing circuitry creates five voltage zones with three zones in the output stage similar to those shown in FIG. 2. FIG. 5A shows a push-pull high-swing output amplifier with an auxiliary stage created using two operational amplifiers (op amps), where the three zones are automatically formed with the auxiliary op amps without using dedicated self-zoned biasing circuits. For the auxiliary stage, FIG. 5B shows the main circuitry (black) and the self-zoned biasing circuitry (grey).

In the output stage, FETs 512 and 518 are thin-oxide devices with fast response times and an OV rating of 1.0 V. In contrast, FETs 514 and 516 are thick-oxide devices with slower response times and an OV rating of 1.8 V. The two $V_{dd}/4$ zones and the $V_{dd}/2$ zone sandwiched between the two $V_{dd}/4$ zones are automatically biased as the two input voltages of each auxiliary op amp follow each other. As shown in FIG. 5B, the master voltage $V_{dd}$ can be 3.3V in order to maintain the voltage drop of each voltage zone below the OV rating of the circuit elements in the corresponding voltage zones (e.g., the zone voltage drops are maintained at $V_{dd}/2=1.65$ V which is less than the OV rating of 1.8 V).

FIG. 5B also shows the voltage zoning in two zones, an upper $V_{dd}/2$ zone and a lower $V_{dd}/2$ zone to provide voltage biases to the auxiliary op amps, which are designated as op amp (P) 522 and op amp (N) 524. The grey circuit elements correspond to the self-zoned biasing circuits. The black circuit elements in the upper $V_{dd}/2$ zone correspond to circuit elements of op amp (P) 522, wherein corresponding circuit inputs are labeled with voltages $V_{sp}$, $V_{gp}$, and $3V_{dd}/4$ in both FIG. 5B and FIG. 5A. Both the upper and lower $V_{dd}/2$ zones in FIG. 5B are biased using self-zoned circuit elements having an OV rating of 1.8 V. Similar to the upper $V_{dd}/2$ zone, the lower $V_{dd}/2$ zone in FIG. 5B shows circuit elements (black) corresponding to op amp (N) and circuit elements (grey) corresponding to the self-zoned biasing circuit. Because the emphasis here is on the self-zoned biasing circuit, the schematic diagram of the op amp circuits is not relevant and therefore the op amp circuits not discussed herein. Similar to the self-zoned biasing circuits in FIG. 3 and FIG. 4, voltage bias is provided using a voltage mirror. For example, the configuration and parameters of FET 614 and FET 616 are chosen such that the voltage $V_{dd}/2$ of the source of FET 614 equals the source FET 616 because the gate-to-source voltage of FET 614 is equal to the gate-to-source voltage of FET 616 and the gate and drain of FET 616 is connected to the gate of FET 614. Also, the pairing of FET 618 and FET 620 as well as the pairing of FET 618 and FET 612 provides voltage bias to the op amp (P) 522 using a voltage mirror configuration. The source of the FET 612 and FET 620 are maintained at the soft rail voltage $V_{dd}/2$ equal to the source voltage of FET 618 because the gate-to-source voltage of FET 618 is configured to be equal to the gate-to-source voltage of FET 620 and the gate-to-source voltage of FET 612.

The self-zoned biasing circuits have several advantages over conventional biasing circuits. First, the configuration is universal because it does not depend on a particular technology for the self-zoned biasing circuit implementation. The voltage zones topology can be implemented in many different circuit fabrication technologies. Second, the self-zoned biasing circuits provide systematic OV prevention. Third, circuits receiving voltage biases using a self-zoned biasing circuit are capable of operating at high speeds because these circuits can avoid relying on special high-voltage devices that are usually slow and bulky. Fourth, using self-zoned biasing circuits enables flexibility to optimize system tradeoffs between signal-to-noise performance and power efficiency by enabling scaling of the master voltage $V_{dd}$ to optimize performance for a particular application. For example, one device can be utilized for multiple applications, such as supplying voltage biases to 3.3V broadband chips or supplying voltage biases to Ethernet PHY chips for small business or automotive applications using a voltage of 2.5V or lower.

While certain implementations have been described, these implementations have been presented by way of example only, and are not intended to limit the teachings of this disclosure. Indeed, the novel methods, apparatuses and systems described herein may be embodied in a variety of other forms; furthermore, various omissions, substitutions and changes in the form of the methods, apparatuses and systems described herein may be made without departing from the spirit of this disclosure.

The invention claimed is:

1. A voltage supply, comprising:

a voltage-divider network configured to divide a master voltage into at least one intermediate voltage;

a plurality of voltage zones, each voltage zone including at least one main circuit;

at least one soft rail configured to supply a voltage bias to the plurality of voltage zones, a voltage of the at least one soft rail being the at least one intermediate voltage; and at least one buffer circuit configured to provide the voltage bias to the at least one soft rail and configured to maintain the voltage of the at least one soft rail at the at least one intermediate voltage.

2. The voltage supply according to claim 1, wherein the at least one intermediate voltage scales with the master voltage.

3. The voltage supply according to claim 1, wherein the voltage divider network includes high-impedance resistors electrically connected in series and the at least one intermediate voltage is a voltage at an interface between adjacent high-impedance resistors.

4. The voltage supply according to claim 1, wherein the at least one buffer circuit includes a first voltage mirror having a first field-effect transistor (FET) supplying the voltage bias to a first main circuit of the at least one main circuit, and a second FET in series with a first current source and the second FET having a source electrically connected to the voltage divider network, wherein a gate of the first FET electrically connects to a gate and drain of the second FET.

5. The voltage supply according to claim 1, wherein the at least one buffer circuit corresponding to a respective voltage zone of the plurality of voltage zones uses circuit elements having a same over-voltage rating as circuit elements of the at least one main circuits corresponding to the same respective voltage zone of the plurality of voltage zones.

6. The voltage supply according to claim 1, wherein the plurality of voltage zones includes a first voltage zone, a second voltage zone, and a third voltage zone; and the at least one soft rail includes a first soft rail corresponding to a first intermediate voltage $\beta V_{dd}$ and a second soft rail corresponding to a second intermediate voltage $\alpha V_{dd}$, wherein the first voltage zone receives a voltage bias from a master-upper rail at the master voltage $V_{dd}$ and the first soft rail such that a voltage drop across the first voltage zone is $(1-\beta)V_{dd}$, the second voltage zone receives the voltage bias from the first soft rail and the second rail, such that the voltage drop across the first voltage zone is $(\beta-\alpha)V_{dd}$, and the third voltage zone receives a voltage bias from the second rail and a master-lower rail at a voltage $V_{ss}=0$, such that the voltage drop across the first voltage zone is $\alpha V_{dd}$.

7. The voltage supply according to claim 1, wherein the at least one buffer circuit is configured to operate in a triode region conserving headroom when the master voltage is less than a predetermined threshold, and the at least one buffer circuit is configured to operate in a saturation region when the master voltage exceeds the predetermined threshold.

8. The voltage supply according to claim 1, wherein the at least one main circuit includes a high-swing main circuit, wherein the high-swing main circuit receives a voltage bias from a first soft rail of the at least one soft rail, the first soft rail including a first buffer circuit, and the high-swing main circuit receives a voltage bias from a second soft rail of the at least one soft rail, the second soft rail including a second buffer circuit, the first buffer circuit includes a voltage mirror having a first FET and a second FET, the second FET has a source electrically connected to the voltage divider network, a gate and drain of the second FET are electrically connected to a gate of the first FET, and a drain of the first FET is electrically connected to the main circuit, the second buffer circuit includes a voltage mirror having a third FET and a fourth FET, the fourth FET has a source electrically connected to the voltage divider network, a gate and drain of the fourth FET are electrically connected to a gate of the third FET, and a drain of the third FET is electrically connected to the main circuit, the first and the second FETs are both PMOS FETs and the third and the fourth FETs are both NMOS FETs, and the first soft rail corresponds to a greater voltage than a voltage corresponding to the second soft rail.

9. The voltage supply according to claim 1, wherein the at least one main circuit includes a low input-impedance main circuit receiving a voltage bias from a master-upper rail and a first soft rail of the at least one soft rail, and the first soft rail includes a first buffer circuit, wherein the first buffer circuit includes a voltage mirror having a first FET and a second FET, the second FET has a source electrically connected to the voltage divider network, a gate and drain of the second FET are electrically connected to a gate of the first FET, and a drain of the first FET is electrically connected to the main circuit, the first and the second FETs are both NMOS FETs, and the first soft rail corresponds to a voltage less than a voltage corresponding to the master-upper rail.

10. The voltage supply according to claim 1, wherein the at least one main circuit includes a high input-impedance main circuit receiving a voltage bias from a master-lower rail and a first soft rail of the at least one soft rail, and the first soft rail includes a first buffer circuit, wherein the first buffer circuit includes a voltage mirror having a first FET and a second FET, the second FET has a source electrically connected to the voltage divider network, a gate and drain of the second FET are electrically connected to a gate of the first FET, and a drain of the first FET is electrically connected to the main circuit, the first and the second FETs are both PMOS FETs, and the first soft rail corresponds to a voltage greater than a voltage corresponding to the master-lower rail.

11. The voltage supply according to claim 4, wherein the first current source is configured as half of a current mirror, the current mirror including a third FET and a fourth FET, the third FET being the first current source and the fourth FET being the other half of the current mirror, a current through the fourth FET being derived from a master current, and a gate of the third FET being electrically connected to a gate and a drain of the fourth FET.

12. The voltage supply according to claim 6, wherein the the first voltage zone corresponds to a first main circuit of the at least one main circuit having PMOS circuit elements;

the second voltage zone corresponds to a second main circuit of the at least one main circuit having cascode circuit elements; and the third voltage zone corresponds to a third main circuit of the at least one main circuit having NMOS circuit elements.

13. The voltage supply according to claim 1, wherein the plurality of voltage zones includes a first voltage zone and a second voltage zone;

the at least one soft rail includes a first soft rail corresponding to a first intermediate voltage $\gamma V_{dd}$, wherein the first voltage zone receives a voltage bias from a master-upper rail and the first soft rail such that a voltage drop across the first voltage zone is $(1-\gamma)V_{dd}$, and the second voltage zone receives a voltage bias from the first soft rail and a master-lower rail at a voltage $V_{ss}=0$, such that a voltage drop across the second voltage zone is $\gamma V_{dd}$.

14. The voltage supply according to claim 6, wherein the plurality of voltage zones further includes a fourth voltage zone and a fifth voltage zone; and the at least one soft rail further includes a third soft rail corresponding to a third intermediate voltage $\gamma V_{dd}$, wherein the fourth voltage zone receives a voltage bias from the master-upper rail at the master voltage $V_{dd}$ and the third soft rail such that a voltage drop across the fourth voltage zone is $(1-\gamma)V_{dd}$, and the fifth voltage zone receives a voltage bias from the third soft rail and the master-lower rail, such that a voltage drop across the fifth voltage zone is $\gamma V_{dd}$.

15. The voltage supply according to claim 13, wherein the the first voltage zone corresponds to a first main circuit of the at least one main circuit having PMOS circuit elements; and the second voltage zone corresponds to a second main circuit of the at least one main circuit having NMOS circuit elements.

16. The voltage supply according to claim 14, wherein the the fourth voltage zone corresponds to a fourth main circuit of the at least one main circuit having PMOS circuit elements; and the fifth voltage zone corresponds to a fifth main circuit of the at least one main circuit having NMOS circuit elements.

17. A method of supplying voltage to a plurality of voltage zones, each voltage zone including at least one main circuit, the method comprising:

dividing a master voltage into at least one intermediate voltages using a voltage-divider network;

maintaining an at least one soft rail at the at least one intermediate voltages using an at least one buffer circuit electrically connected to the voltage-divider network; and supplying a voltage bias to the at least one main circuit included in each of the plurality of voltage zones using the soft rail maintained at the least one intermediate voltages.

18. The method according to claim 17, wherein the at least one buffer circuit includes a first voltage mirror having a first field-effect transistor (FET) supplying the voltage bias to a first main circuit of the at least one main circuit, and a second FET in series with a first current source and the second FET having a source electrically connected to the voltage divider network, wherein a gate of the first FET electrically connects to a gate and drain of the second FET.

19. The method according to claim 17, wherein the plurality of voltage zones includes a first voltage zone, a second voltage zone, and a third voltage zone; and the at least one soft rail includes a first soft rail corresponding to a first intermediate voltage $\beta V_{dd}$ and a second soft rail corresponding to a second intermediate voltage $\alpha V_{dd}$, wherein the first voltage zone receives a voltage bias from a master-upper rail at the master voltage $V_{dd}$ and the first soft rail at the first intermediate voltage $\beta V_{dd}$ such that a voltage drop across the first voltage zone is $(1-\beta)V_{dd}$, the second voltage zone receives a voltage bias from the first soft rail and the second rail, such that a voltage drop across the first voltage zone is $(\beta-\alpha)V_{dd}$, and the third voltage zone receives a voltage bias from the second rail at the second intermediate voltage $\alpha V_{dd}$ and a master-lower rail at a voltage $V_{ss}=0$, such that a voltage drop across the first voltage zone is $\alpha V_{dd}$.

20. A voltage supply, comprising:

voltage-dividing means for dividing a master voltage into at least one intermediate voltage;

a plurality of voltage zones, each voltage zone including at least one main circuit;

voltage-bias-supplying means for supplying a voltage bias to the plurality of voltage zones, the voltage of the voltage-bias-supplying means being the at least one intermediate voltage; and buffering means for providing the voltage bias to at least one soft rail while maintaining a voltage of the at least one soft rail at the at least one intermediate voltage.

* * * * *